US008678884B2

(12) United States Patent
Tanimoto et al.

(10) Patent No.: US 8,678,884 B2
(45) Date of Patent: Mar. 25, 2014

(54) PORTABLE ABRASIVE TOOL

(75) Inventors: Hideyuki Tanimoto, Hitachinaka (JP); Takuya Konnai, Hitachinaka (JP); Kouji Sagawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 279 days.

(21) Appl. No.: 12/941,641

(22) Filed: Nov. 8, 2010

(65) Prior Publication Data

US 2011/0108302 A1 May 12, 2011

(30) Foreign Application Priority Data

Nov. 6, 2009 (JP) ..... 2009-255581

(51) Int. Cl.
*B24B 23/00* (2006.01)

(52) U.S. Cl.
USPC ..... 451/359; 451/344; 310/50; 310/49.06; 310/49.07

(58) Field of Classification Search
USPC ..... 451/344, 353, 357, 359; 310/50, 49.02, 310/49.06, 49.07, 46, 164
See application file for complete search history.

(56) References Cited

U.S. PATENT DOCUMENTS 2,814,746 A * 11/1957 Boerdijk ..... 310/164
4,207,483 A * 6/1980 Baer ..... 310/49.07
4,559,461 A * 12/1985 Takahashi et al. ..... 310/49.07
5,614,775 A * 3/1997 Horski et al. ..... 310/68 R
5,770,900 A * 6/1998 Sato et al. ..... 310/49.13
7,083,508 B2 * 8/2006 Swaddle et al. ..... 451/344
7,101,274 B1 * 9/2006 Etter et al. ..... 451/344
7,462,967 B2 * 12/2008 Maruyama et al. ..... 310/75 D
7,825,556 B2 * 11/2010 Suzuki et al. ..... 310/90
2002/0009962 A1 * 1/2002 Swaddle et al. ..... 451/355
2002/0028645 A1 * 3/2002 Link ..... 451/344
2006/0163955 A1 * 7/2006 Maruyama et al. ..... 310/68 B
2008/0252161 A1 * 10/2008 Kubo ..... 310/90.5

FOREIGN PATENT DOCUMENTS

JP 60-153751 U 10/1985
JP 61-41360 U 3/1986
JP 63-011272 A 1/1988
JP 2005-279891 10/2005

OTHER PUBLICATIONS

Japanese Office Action with English translation issued in Japanese Application No. 2009-255581 issued Oct. 22, 2013.

* cited by examiner

*Primary Examiner* — Eileen P. Morgan
(74) *Attorney, Agent, or Firm* — McDermott Will & Emery LLP

(57) ABSTRACT

The portable abrasive tool comprises a flat motor composed of a rotor having a coil disk in the form of a disk on which multiple coil pieces are arranged in the circumferential direction about the output shaft when seen in the direction of the axis line of the output shaft and a stator having magnets arranged in the manner that the magnetic flux passes through the coil disk in the direction of the axis line of the output shaft, and an abrasive part connected to one end of the output shaft of the flat motor.

11 Claims, 18 Drawing Sheets

PORTABLE ABRASIVE TOOL

CROSS-REFERENCE TO RELATED APPLICATION

This application claims the benefit of Japanese Patent Application No. 2009-255581, filed on Nov. 6, 2009, the entire disclosure of which is incorporated by reference herein.

FIELD

This application relates generally to a portable abrasive tool used in abrasive operation, and more particularly, to a portable electric abrasive tool having a flat motor.

BACKGROUND

As disclosed in Unexamined Japanese Patent Application KOKAI Publication No. 2005-279891, a portable abrasive tool such as a sander and polisher works with the pad supporting an abrasive sheet such as a sanding paper being driven by a motor. Generally, the motor used in a portable abrasive tool is composed of a rotor consisting of a coil wound around a columnar iron core extending in the axial direction of the output shaft of the motor and a cylindrical stator enclosing the rotor. Then, the motor is accommodated in the housing of a portable abrasive tool that is held by the user.

In a portable abrasive tool having the motor as described above, the rotor and stator are elongated in the axial direction of the output axis of the motor. Therefore, the housing of a portable abrasive tool is governed by the motor in shape and it is difficult to produce a portable abrasive tool compact in the axial direction of the motor output shaft. As the dimension in the axial direction of the motor output shaft is increased, the abrasive surface and the gravity center of the abrasive tool are more separated. Then, a problem is that the abrasive surface is easily tilted during abrasive operation, making the abrasive operation difficult to handle.

SUMMARY

The present invention is made in view of the above problem and an exemplary object of the present invention is to provide a portable abrasive tool having a reduced dimension in the axial direction of the motor output shaft so as to be excellent in operability.

In order to achieve the above object, the portable abrasive tool of the present invention comprises a flat motor composed of a rotor having an output shaft and a stator wherein one of the rotor and stator has a coil disk in the form of a disk on which multiple coil pieces are arranged in the circumferential direction about the output shaft when seen in the axial direction of the output shaft and the other of the rotor and stator has a magnetic flux generation unit generating a magnetic flux passing through the coil disk in the axial direction of the output shaft; and an abrasive part connected to one end of the output shaft of the flat motor.

Furthermore, the coil disk may be provided to the rotor; the stator may constitute a housing which rotatably supports the output shaft and encloses the coil disk; the magnetic flux generation unit may comprise magnets; a handle may be provided to the housing; and the flat motor may be provided between the handle and abrasive part.

Furthermore, the coil disk may be provided to the rotor; the stator may constitute a housing which rotatably supports the output shaft and encloses the coil disk; the magnetic flux generation unit may comprise magnets; the housing may have a flat part nearly parallel to the disk surface of the coil disk on the side where the other end of the output shaft is situated, and a nearly columnar protrusion protruding from the flat part nearly coaxially with the output shaft and having a diameter smaller than the diameter of the coil disk; and a handle for the operator to hold may be provided at the end of the protrusion that is away from the flat part.

Furthermore, the handle may have a facing-the-housing part facing the flat part of the housing and having an outer peripheral edge outside the outer diameter of the protrusion when seen in the axial direction of the output shaft; and a control switch for controlling the operation of the flat motor may be provided on the facing-the-housing part of the handle.

Furthermore, the coil disk may be provided to the rotor; the stator may constitute a housing which rotatably supports the output shaft and encloses the coil disk; the housing may have a flat part nearly parallel to the disk surface of the coil disk on the side where the other end of the output shaft is situated; and a handle for the operator to hold may be provided on the flat part, the handle having a handle protrusion protruding from the flat part in the axial direction of the output shaft and a handle grip extending from the end of the handle protrusion that is away from the flat part nearly in parallel to the flat part.

Furthermore, a control switch for controlling the operation of the flat motor may be provided on the handle grip at a position facing the flat part.

Furthermore, a power cord protrusion protruding in the direction nearly perpendicular to the axial direction of the output shaft and in which a power cord for feeding the flat motor runs may be provided to the housing; and the handle grip of the handle may pass through nearly the center of the output shaft when seen in the axial direction of the output shaft and extend nearly in parallel to the power cord protrusion.

Furthermore, possibly, the coil disk may be provided to the rotor; the stator may constitute a housing which rotatably supports the output shaft and encloses the coil disk; the housing may have a flat part nearly parallel to the disk surface of the coil disk on the side where the other end of the output shaft is situated; and a side handle for the operator to hold may be provided to the housing, the side handle protruding from the housing in the direction nearly perpendicular to the axial direction of the output shaft when seen in the axial direction of the output shaft.

Furthermore, the magnets may be provided in the housing in the manner that they face one of the disk surfaces of the coil disk.

Furthermore, the housing may have an outer peripheral wall facing the circumference of the coil disk; and multiple cooling holes communicating with the interior of the housing accommodating the coil disk may be formed in the outer peripheral wall.

Furthermore, the rotor may have an outer diameter radially larger than a diameter of the abrasive part.

Using a flat motor, the present invention can reduce the dimension in the axial direction of the output shaft of the motor of a portable abrasive tool and reduce the distance between the abrasive surface and the gravity center of the portable abrasive tool, improving the operability.

BRIEF DESCRIPTION OF THE DRAWINGS

A more complete understanding of this application can be obtained when the following detailed description is considered in conjunction with the following drawings, in which.

DETAILED DESCRIPTION

Figure 1:
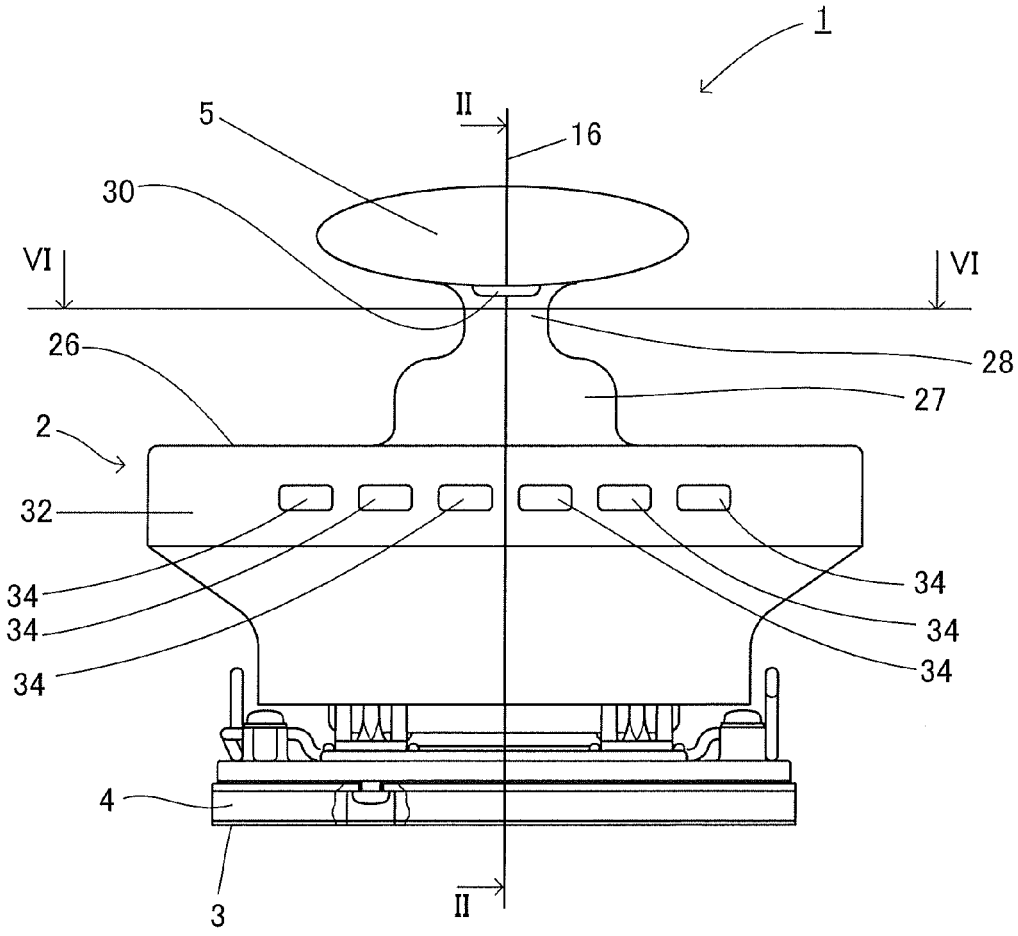
FIG. 1 is a front view of the portable abrasive tool according to Embodiment 1 of the present invention.

Embodiment 1 of the present invention will be described hereafter with reference to FIGS. 1 to 6. As shown in FIG. 1, a portable abrasive tool 1 as a sander or polisher comprises a housing 2 accommodating a motor (not shown) therein, a pad 4 connected to the output shaft of a motor (not shown) and supporting an abrasive sheet 3 such as a sanding paper, and a handle 5 attached to the housing 2.

Figure 2:
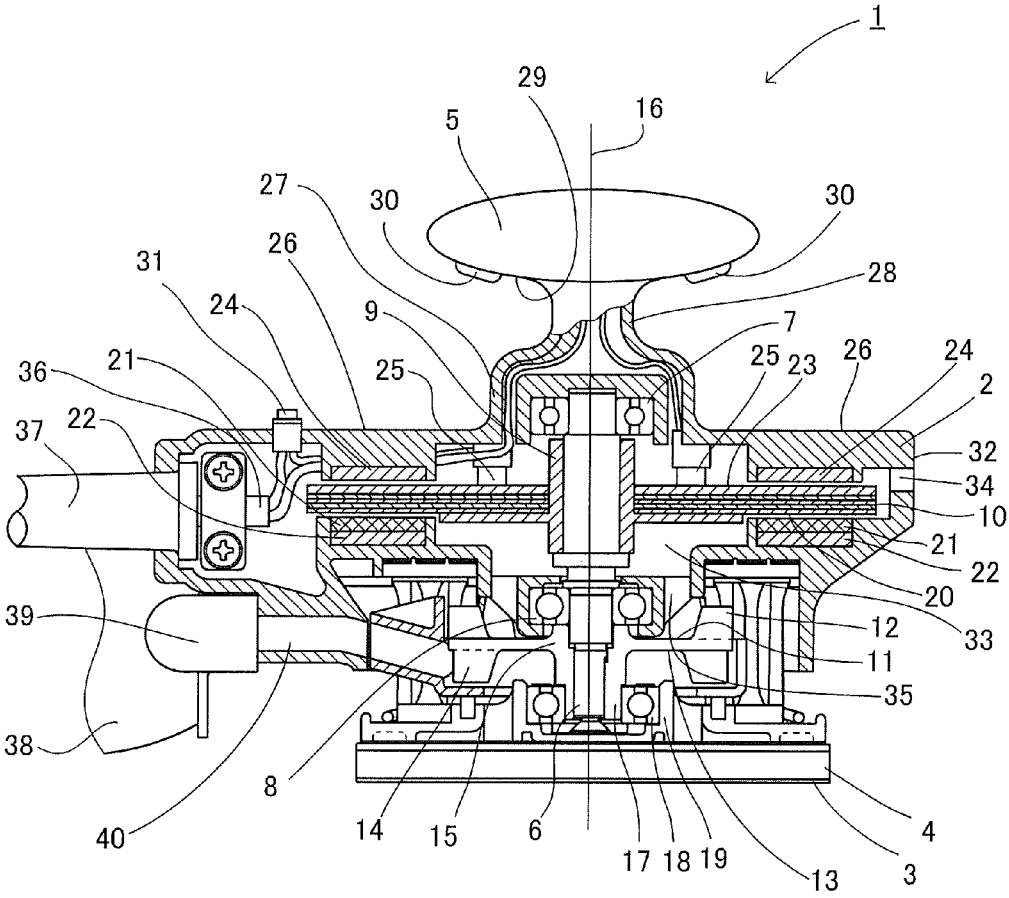
FIG. 2 is a cross-sectional view at the line II-II in FIG. 1.

As shown in FIG. 2, an output shaft 6 is rotatably supported by a first bearing 7 and a second bearing 8 in the housing 2. A coil disk 10 nearly in the form of a disk consisting of a laminate of multiple disks having multiple coil patterns on the surface is secured to the output shaft 6 via a flange 9 between the first and second bearings 7 and 8. The output shaft 6, flange 9, and coil disk 10 constitute a rotor rotating as one piece. A fan 15 rotating together with the output shaft 6 is attached to the output shaft 6 below the second bearing 8 in FIG. 2. Multiple motor-cooling fan blades 12 are formed on the upper disk surface 11 of the disk-shaped fan 15 and multiple dust-collecting fan blades 14 are formed on the lower disk surface 13 of the fan 15. An eccentric shaft 17 eccentric with respect to the central axis 16 extends from the lower disk surface 13 of the fan 15 downward in the direction of the axis line 16 (central axis) of the output shaft 6. A pad 4 is attached to the eccentric shaft 17 via a third bearing 18 and a bearing cover 19. Here, the fan 15 does not necessarily have the eccentric shaft 17 and can be coaxial with the output shaft 6.

The housing 2 contains multiple magnets 21 such as permanent magnets or electromagnets facing the lower disk surface 20 of the coil disk 10 and spaced in the circumferential direction and an annular iron yoke 22 so that the magnetic flux passes through the coils of the coil disk 10 in the direction of the axis line 16 (the axial direction) of the output shaft 6. The housing 2 further contains an annular iron yoke 24 facing the upper disk surface 23 of the coil disk 10 at the opposite position to the iron yoke 22 across the coil disk 10 when seen in the direction of the axis line 16 of the output shaft 6. The magnets 21 and iron yokes 22 and 24 constitute a magnetic flux generation unit. Here, the magnetic flux generation unit is not confined to this structure as long as the magnetic flux passes through the coils of the coil disk 10 in the direction of the axis line 16 of the output shaft 6. For example, the magnetic flux generation unit can consists of multiple permanent magnets, electromagnets, or coils only. The housing 2 in which the magnets 21 and iron yokes 22 and 24 are provided constitutes a stator. The housing 2 further contains a brush 25 making contact with the upper disk surface 23 of the coil disk 10 to feed the coils of the coil disk 10. The coil disk 10 secured to the output shaft 6, which serves as a rotor, the magnets 21 and iron yokes 22 and 24, which serve as a stator, and brush 25 constitute a flat direct-current commutator motor (flat motor).

Figure 3:
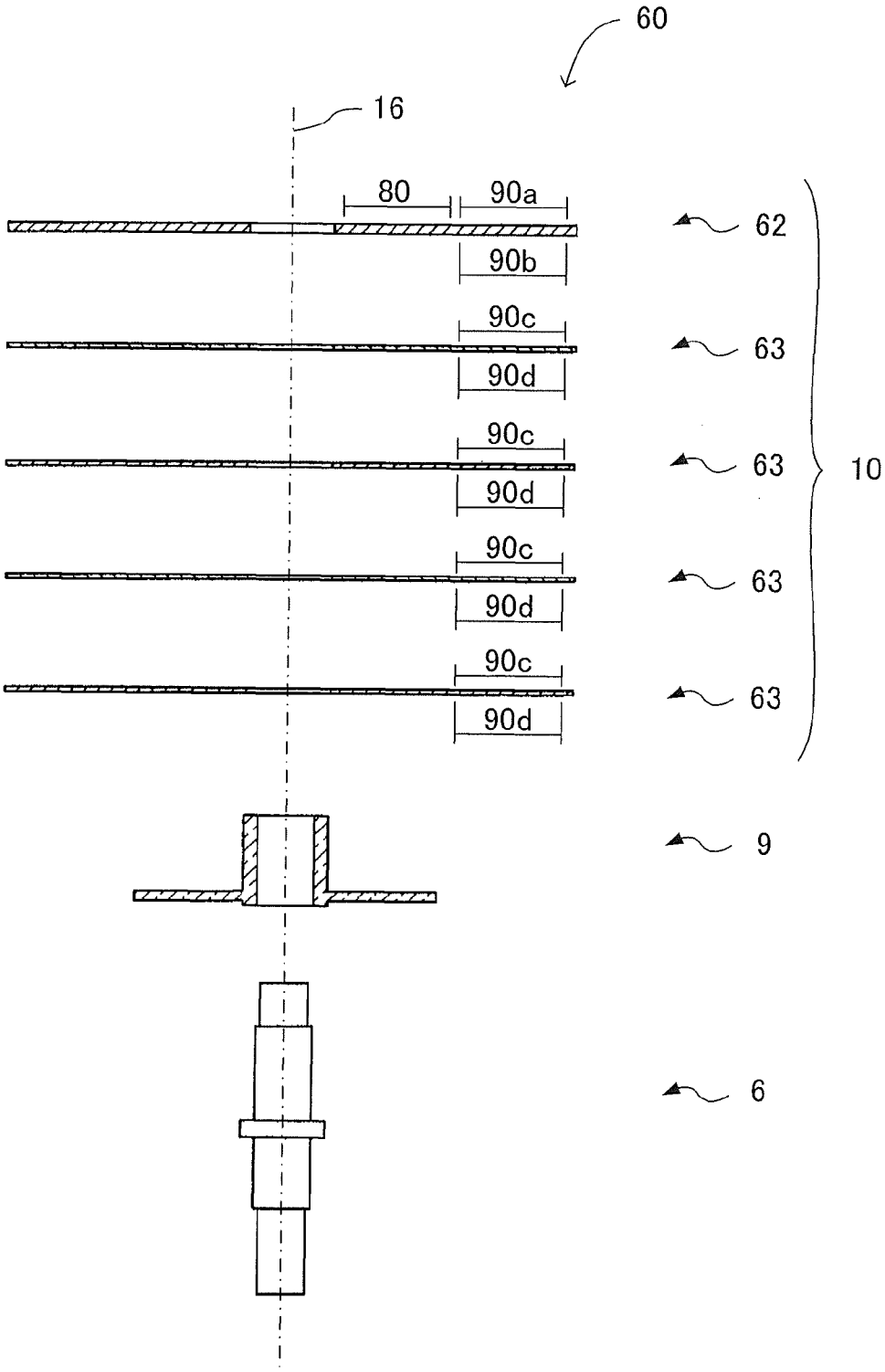
FIG. 3 is an exploded cross-sectional view of the rotor of the portable abrasive tool in FIG. 1.

As shown in FIG. 3, the rotor 60 of the flat motor is comprised of the output shaft 6, flange 9, and coil disk 10 consisting of a laminate of a coil/commutator disk 62 and four coil disk parts 63 from the top in FIG. 3. The coil/commutator disk 62 and coil disk parts 63 are printed wiring boards each consisting of an insulator board and a conductor pattern(s). A commutator region 80 in which a commutator conductor pattern is formed and a coil region 90*a* in which a coil conductor pattern is formed are provided on the top surface of the coil/commutator disk 62. The commutator region 80 and the coil region 90*a* are each annular about the axis line 16 when seen in the direction of the axis line 16 of the output shaft 6. The coil region 90*a* is situated outside the commutator region 80. Furthermore, a coil region 90*b* for forming a coil conductor pattern is provided on the underside of the coil/commutator disk 62. The coil region 90*b* is annular about the axis line 16 and overlaps with the coil region 90*a* when seen in the direction of the axis line 16.

Figure 4:
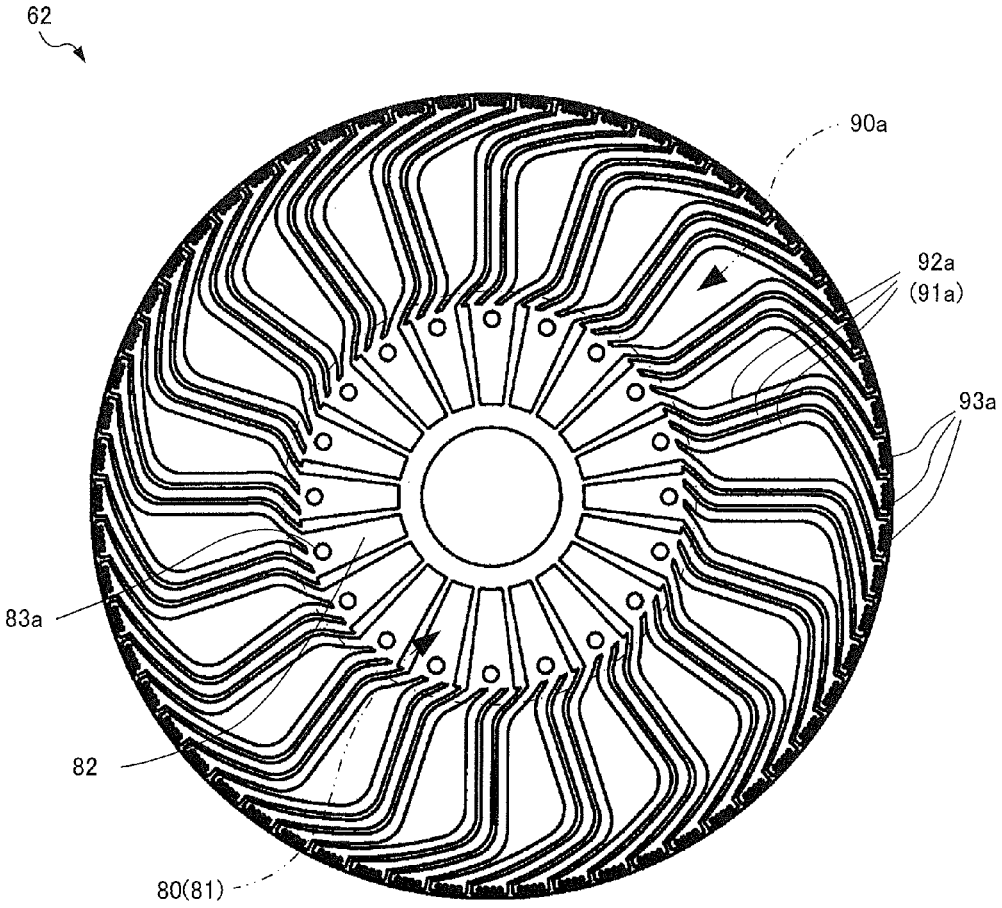
FIG. 4 is a top view of the coil/commutator disk of the rotor in FIG. 3.

As shown in FIG. 4, the conductor pattern in the commutator region 80 on the top surface of the coil/commutator disk 62 forms a commutator 81 that makes contact with the brush 25. The commutator 81 is composed of multiple commutator segments 82 arranged radially about the axis line 16. A through-hole 83*a* running through the coil/commutator disk 62 is formed at the outer end of each commutator segment 82.

The conductor pattern in the coil region 90*a* on the top surface of the coil/commutator disk 62 forms multiple coil segments 92*a* arranged radially about the axis line 16. The inner end of each coil segment 92*a* is directly connected to the corresponding commutator segment 82. The outer end of each coil segment 92*a* is bent in a given direction about the axis line 16. Multiple through-holes 93*a* running through the coil/commutator disk 62 are formed at the outer end of each coil segment 92*a*.

Nearly the same conductor pattern as the one in the coil region 90*a* shown in FIG. 4 is provided in the coil region 90*b* on the underside of the coil/commutator disk 62 to form not-shown multiple coil segments arranged radially about the axis line 16. The outer end of each not-shown coil segment is connected to the corresponding coil segment 92*a* in the coil region 90*a* via solder filled in the through hole 93*a*. The inner end of each not-shown coil segment is connected to the corresponding commutator segment 82 in the commutator region 80 via solder filled in the through hole 83*a*. Then, the multiple coil segments 92*a* in the coil region 90*a* and the not-shown multiple coil segments in the coil region 90*b* constitute multiple coils 91*a* nearly in the form of a horizontal U-shape when seen in the direction of the axis line 16. The multiple coils 91*a* are arranged in the circumferential direction about the axis line 16. Furthermore, the end of each coil 91*a* is connected to the corresponding commutator segment 82 in the commutator region 80.

As shown in FIG. 3, each coil disk part 63 has coil regions 90*c* and 90*d* on the top surface and underside thereof in which coil conductor patterns are formed. The coil regions 90*c* and 90*d* are each annular about the axis line 16 and overlap with the coil regions 90*a* and 90*b* of the coil/commutator disk 62 when seen in the direction of axis line 16.

Figure 5:
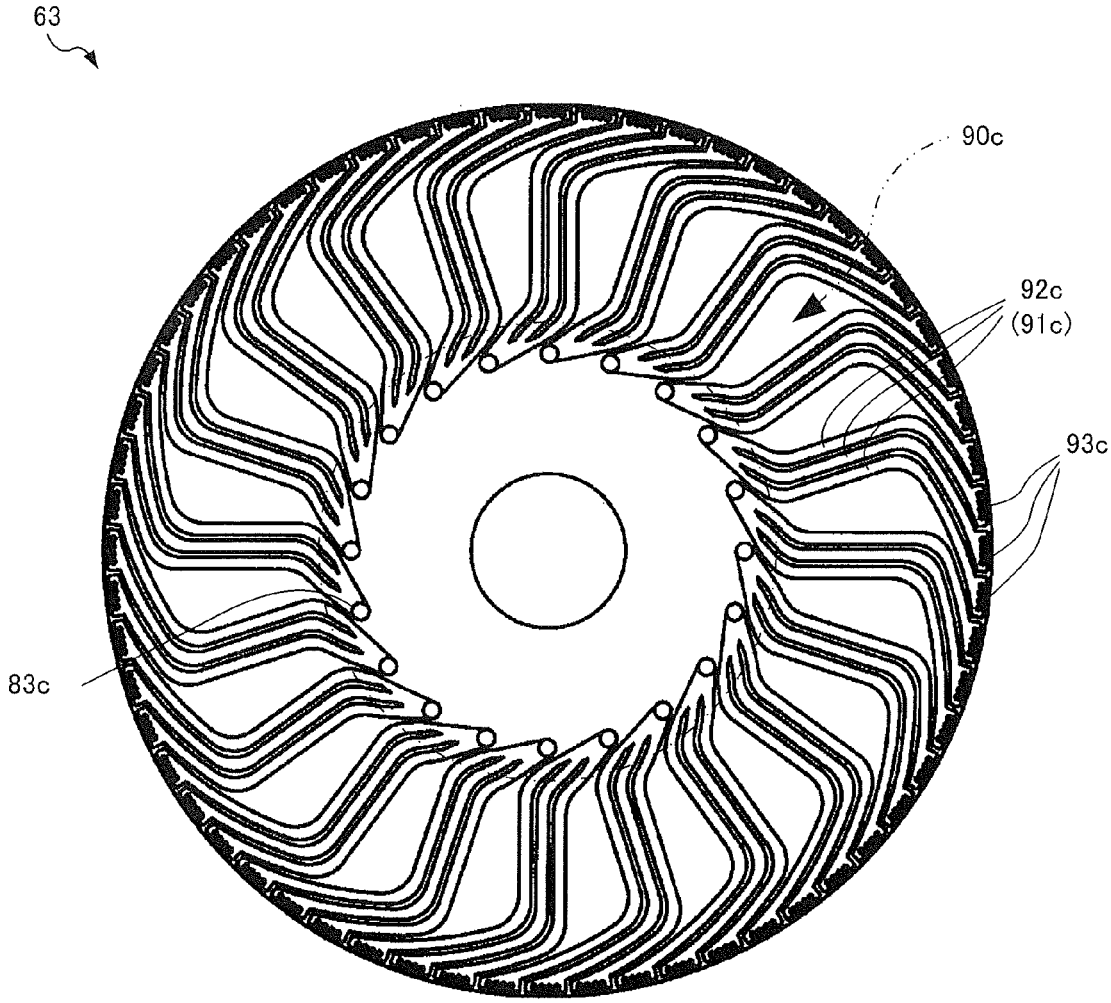
FIG. 5 is a top view of the coil disk part of the rotor in FIG. 3.

Nearly the same conductor pattern as the one in the coil regions 90*a* and 90*b* of the coil/commutator disk 62 is formed in the coil regions 90*c* and 90*d* of the coil disk parts 63. Multiple coil segments 92*c* are arranged radially about the axis line 16 in the coil region 90*c* on the top surface 90*a* of the coil disk part 63 as shown in FIG. 5. Furthermore, nearly the same conductor pattern as the one in the coil region 90*c* is provided in the coil region 90*d* on the underside of the coil disk part 63 to forms not-shown multiple coil segments. The multiple coil segments 92*c* in the coil region 90*c* and the not-shown multiple coil segments in the coil region 90*d* are connected to each other via solder filled in through-holes 83*c* and 93*c* running through the coil disk 62 to constitute multiple coils 91*c* nearly in the form of a horizontal U-shape when seen in the direction of the axis line 16. The multiple coils 91*c* are arranged in the circumferential direction about the axis line 16. The end of each coil 91*c* is connected to the corresponding commutator segment 82 in the commutator region 80 via solder filled in the through-hole 83*a* of the coil/commutator disk 62.

The conductor patterns in the commutator region 80 and coil region 90*a* of the coil/commutator disk 62 are formed on the same printed wiring. Furthermore, the conductor patterns in the commutator region 80 and coil region 90*a* of the coil/commutator disk 62 have a larger thickness than a thickness of the coil region 90*b* and the coil regions 90*c* and 90*d* of the coil disk parts 63 in order to prevent damage from abrasion by the brush 25.

The coil/commutator disk 62 and coil disk parts 63 are laminated with not-shown insulating layers between the coil/commutator disk 62 and coil disk part 63 and between multiple coil disk parts 63 in the manner that, for example, the coils 91*a* and 91*c* overlap each other when seen in the direction of the axis line 16 or the coils 91*a* and 91*c* are arranged at a given angle about the axis line 16.

Figure 6:
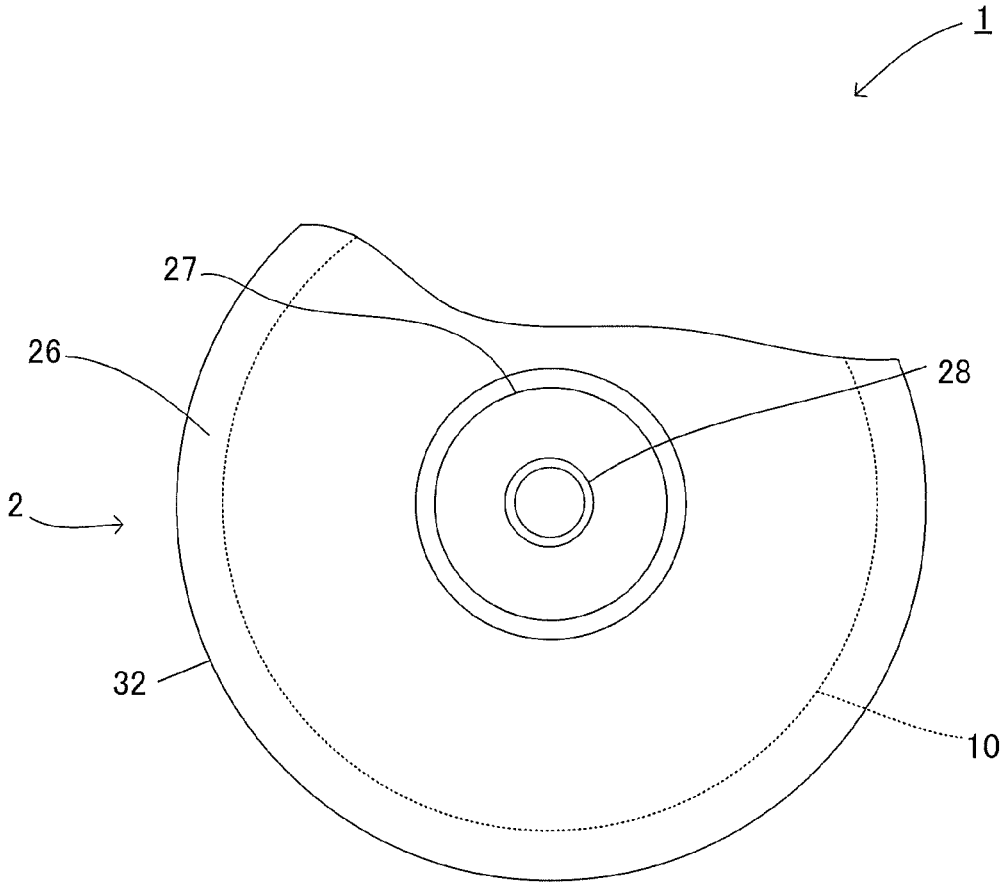
FIG. 6 is a cross-sectional view at the line VI-VI in FIG. 1.

As shown in FIG. 2, a flat part 26 nearly parallel to the disk surfaces 23 and 24 of the coil disk 10 is formed on the side of the housing 2 where the handle 5 is attached. A protrusion 27 nearly columnar about the axis line 16 protrudes from the flat part 26 and extends away from the pad 4 in the direction of the axis line 16 of the output shaft 6. The first bearing 7 is housed in the protrusion 27. As shown in FIG. 6, the protrusion 27 is smaller in outer diameter than the coil disk 10. The handle 5 is attached to the end of the protrusion 27 via a neck 28 having a diameter smaller than the outer diameter of the protrusion 27. The handle 5 has a flattened sphere shape. Two trigger switches (control switches) 30 controlling the rotation/stop of the output shaft 6 are provided on the facing-the-housing part 29 of the handle 5 that faces the flat part 26 at positions on either side of the axis line 16 of the output shaft 6. In the ON state in which one of the two trigger switches 30 is turned on, the output shaft 6 of the flat motor rotates at a set rotation speed. In the OFF state in which neither of the trigger switches is turned on, the output shaft 6 of the flat motor stops. Here, the rotation speed of the output shaft 6 is set by a dialing-type variable speed switch 31 provided on the flat part 26.

As shown in FIGS. 1 and 2, the housing 2 has an outer peripheral wall 32 that faces the circumference of the coil disk 10 and is nearly parallel to the direction of the axis line 16 of the output shaft 6. Multiple cooling through-holes (cooling holes) 34 run through the outer peripheral wall 32 in the direction perpendicular to the axis line 16 of the output shaft 6 to allows the internal space 33 of the housing 2 in which the coil disk 10 is housed to communicate with the outside of the housing 2. The internal space 33 further communicates with the outside of the housing 2 via a cooling air passage 35 and the area where the motor-cooling fan blades 12 are provided.

Furthermore, as shown in FIG. 2, a cord armor (power cord protrusion) 37 in which a power cord 36 runs extends from the outer peripheral wall 32 of the housing 2 in the direction nearly perpendicular to the axis line 16 of the output shaft 6. Furthermore, a dust bag mount 39 on which a dust bag 38 is detachably mounted is provided below the cord armor 37. The dust bag mount 39 is connected to a dust passage 40, which communicates with the area where the dust-collecting fan blades 14 are provided.

In the portable abrasive tool 1 having the above structure, a given voltage is applied to the brush 25 when the trigger switch 30 on the handle 5 is turned on. The voltage applied to the brush 25 is applied to the coils 91*a* and 91*c* formed on the coil disk 10 via the commutator 81. A current flows through the coils 91*a* and 91*c* to which the voltage is applied nearly radially on the coil disk 10 and in the direction perpendicular to the axis line 16 of the output shaft 6. The direction of the current flow is controlled by the commutator 81. On the other hand, the magnetic flux generated by the magnets 21 passes through the coil disk 10 perpendicular to the current in the direction of the axis line 16 of the output shaft 6. Then, a torque occurs on the coil disk 10 in the circumferential direction of the coil disk 10 about the axis line 16. Then, the output shaft 6 rotates together with the coil disk 10.

As the output shaft 6 rotates, the fan 15 rotates. The motor-cooling fan blades 12 formed on the fan 15 sucks the air in the internal space 33 of the housing 2 via the cooling air passage 35. Then, ambient air enters the internal space 33 from the cooling through-holes 34 communicating with the internal space 33. The entered ambient air cools the coil disk 10. On the other hand, the dust-collecting fan blades 14 formed on the fan 15 sucks dust generated during abrasive operation and sends it into the dust bag 38 through the dust passage 40 via the dust bag mount 39. Furthermore, the pad 4 attached via the eccentric shaft 7, third bearing 18, and bearing cover 19 is driven by the rotation of the output shaft 6 so that the abrasion-target surface is abraded by the abrasive sheet 3 attached to the pad 4.

Using a flat motor comprising coils in the disks of the coil disk 10 for the portable abrasive tool 1, the rotor 60 is light-weighted and activated sooner compared with a motor having coils wound around a core. Then, the dimension in the direction of the axis line 16 of the output shaft 6 of the motor can significantly be reduced and the portable abrasive tool 1 can further be downsized. Furthermore, the reduced dimension in the direction of the axis line 16 results in reducing the distance from the gravity center of the handle 5 of the portable abrasive tool 1 and the portable abrasive tool 1 to the abrasive surface of the pad 4 on which the abrasive sheet 3 is attached. Therefore, the abrasive surface is not easily tilted with respect to the abrasion-target surface during the operation, improving the operability.

Furthermore, the housing 2 has the flat part 26 and the protrusion 27 protruding from the flat part 26 on the opposite side to the pad 4. Therefore, the operator can hold the flat part 26 and protrusion 27 of the housing 2 in addition to the handle 5 during abrasive operation, improving the operability. Particularly, the protrusion 27 is smaller in diameter than the coil disk 10 (or the flat part 26) and has a columnar shape nearly coaxial with the output shaft 6. Then, the operator can place his/her hand on the flat part 26 around the protrusion 27. Then, the operator can more easily hold the housing 2, improving the workability. Furthermore, the motor is not placed within the handle 5 and, therefore, the degree of freedom in designing the handle 5 is significantly increased; for example, a handle 5 easier to hold can be provided. Furthermore, the trigger switches 30 controlling the rotation of the output shaft 6 of the motor are provided on the part of the handle 5 that faces the flat part 26 of the housing 2. Then, the operator can operate the trigger switches 30 while holding the handle 5 with a palm, further improving the operability. Furthermore, two trigger switches 30 are provided on either side of the axis line 16. Then, the operator can operate one of the trigger switches 30 that is easier to use depending on how he/she is holding the handle 5, further possibly improving the operability.

Furthermore, the cooling through-holes 34 are formed in the outer peripheral wall 32 of the housing 2. The cooling through-holes 34 are not easily closed up by the operator during the operation and the motor can efficiently be cooled. Furthermore, with the coils 91*a* and 91*c* being provided in the flat disks of the coil disk 10, a large heat discharging area is ensured for the coils 91*a* and 91*c* through which a current runs. Therefore, the coils 91*a* and 91*c* can efficiently be cooled along with the cooling through-holes 34.

Furthermore, the coil disk 10 is so designed as to increase the rotation diameter of the rotor 60. The coil disk 10 has an outer diameter radially larger than an outer diameter of the pad 4 and abrasive sheet 3. Therefore, increased stability allows for operation with excellent operability. Furthermore, the magnets 21 face the disk surface of the coil disk 10. The dimension in the direction perpendicular to the output shaft 6 of the portable abrasive tool 1 can be reduced.

A portable abrasive tool 1001 according to Embodiment 2 of the present invention will be described hereafter with reference to FIGS. 7 to 9. The portable abrasive tool 1001 of this embodiment has a handle 1005 provided on the flat part 26 of a housing 1002 and a protrusion 1027 protruding from the flat part 26, which are modified in shape from the portable abrasive tool 1 of Embodiment 1. The same components as those in Embodiment 1 will be referred to by the same reference numbers and their detailed explanation will be omitted.

Figure 7:
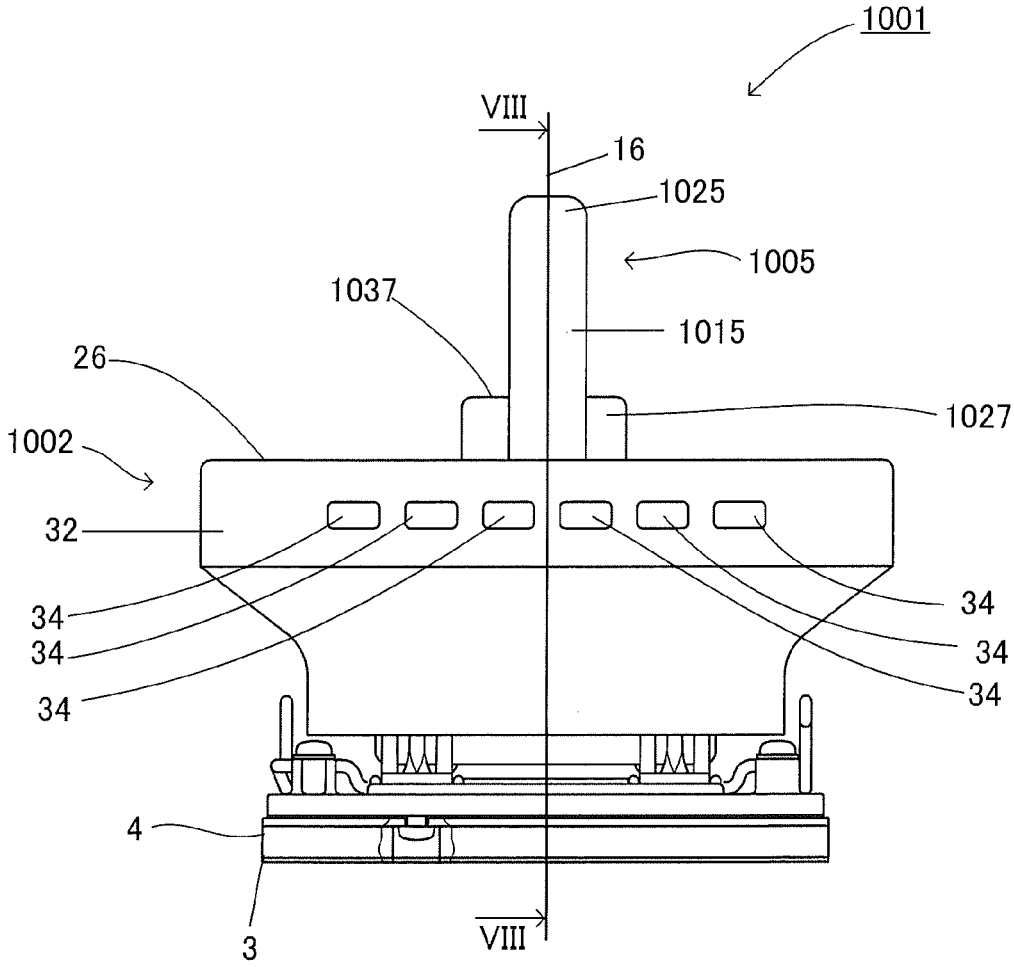
FIG. 7 is a front view of the portable abrasive tool according to Embodiment 2 of the present invention.
Figure 8:
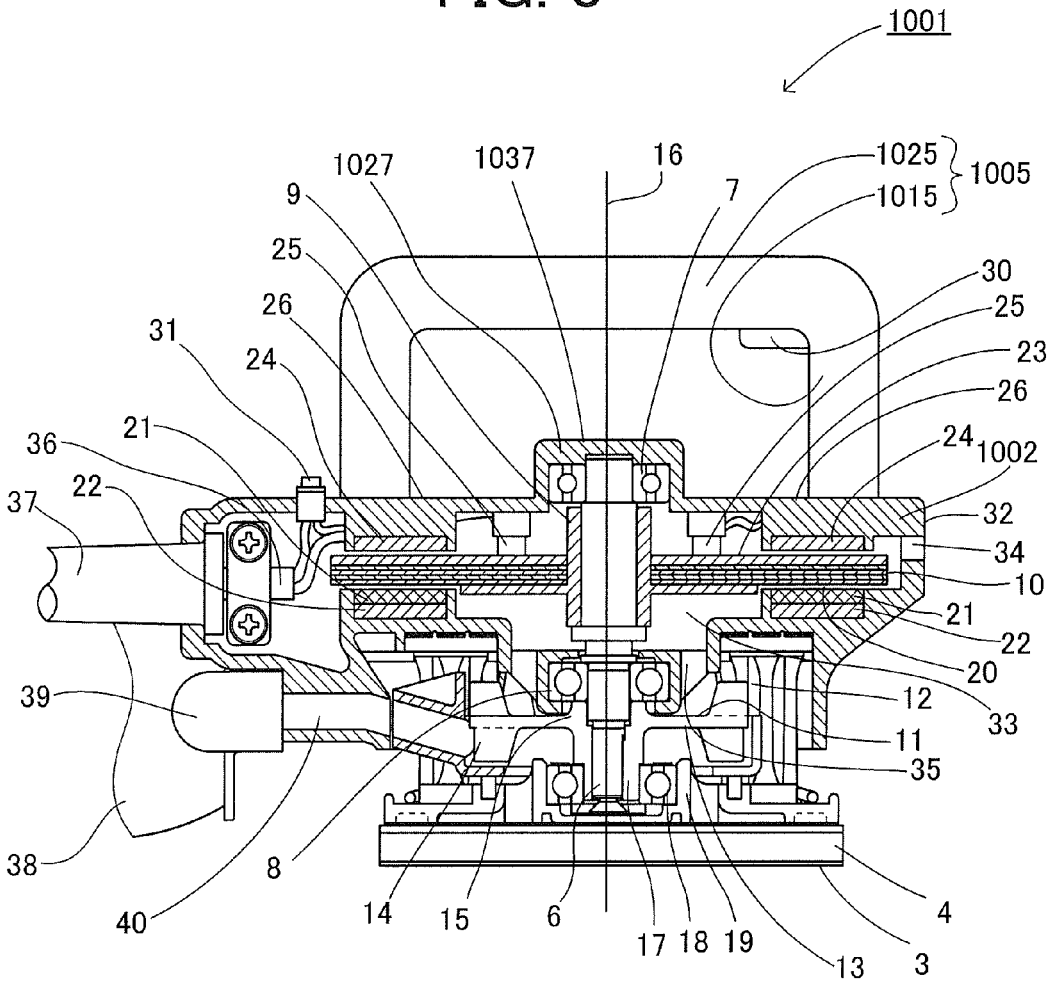
FIG. 8 is a cross-sectional view at the line VIII-VIII in FIG. 7.
Figure 9:
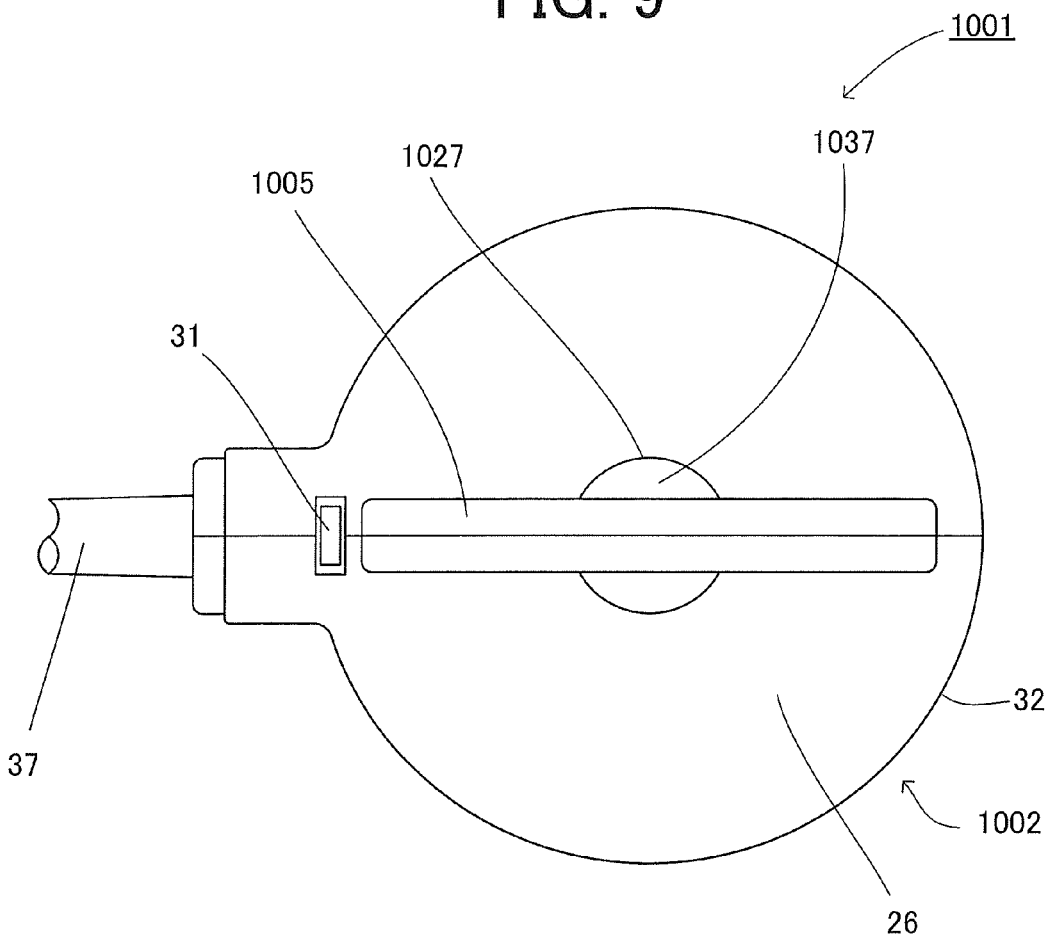
FIG. 9 is a top view of the portable abrasive tool in FIG. 7.

As shown in FIGS. 7 and 8, the handle 1005 is provided on the flat part 26 of the housing 1002. The handle 1005 is composed of an integrated piece of a handle protrusion 1015 protruding from the flat part 26 and extending away from the pad 4 in the direction of the axis line 16 of the output shaft 6 and a handle grip 1025 extending from the end of the handle protrusion 1015 that is away from the flat part 26 nearly in parallel to the flat part 26. Here, as shown in FIG. 9, the handle grip 1025 passes through nearly the center of the output shaft 6 and extends nearly in parallel to the direction in which the cord armor 37 extends when seen in the direction of axis line 16 of the output shaft 6. A trigger switch 30 is provided on the handle grip 1025 of the handle 1005 at a position facing the flat part 26 near the joint to the handle protrusion 1015. Furthermore, a nearly columnar protrusion 1027 that has a surface 1037 nearly parallel to the flat part 26 and is nearly coaxial with the output shaft 6 is formed on the flat part 26. The first bearing 7 is provided in the protrusion 1027 as shown in FIG. 8.

The portable abrasive tool 1001 having the above structure has the above-described advantageous effects as a result of using a flat motor. In addition, the handle protrusion 1015 creates a space between the handle grip 1025 of the handle 1005 and the flat part 26 of the housing 1002. Then, the operator can hold the flat part 26 of the housing along with the handle grip 1025 of the handle 1005, improving the operability. Furthermore, the protrusion 1027 is formed on the flat part 26 of the housing 1002. Then, the operator can place his/her hand on the flat part 26 around the protrusion 1027 below the handle grip 1025. The operator can more easily hold the housing 1002, improving the workability. Furthermore, the trigger switch 30 is provided on the handle 1005 at a position facing the flat part 26 of the housing 1002. Then, the operator can operate the trigger switch 30 while holding the handle grip 1025 of the handle 1005, further improving the operability. Furthermore, the handle grip 1025 extends nearly in parallel to the direction in which the cord armor 37 extends. The power cord 36 does not easily interfere with the abrasive operation. Furthermore, the handle grip 1025 passing through the center of the output shaft 6 facilitates the identification of the abrasive surface position, improving the workability.

A portable abrasive tool 2001 according to Embodiment 3 of the present invention will be described hereafter with reference to FIGS. 10 to 12. In the portable abrasive tool 2001 of this embodiment, the structure relating to the fan 15 and third bearing 18 on the side of the second bearing 8 of the output shaft 6 where the pad 4 is provided in the portable abrasive tool 1 of Embodiment 1 is eliminated and a handle 2005 integrated with a housing 2002 and a side handle 2030 are provided. The same components as those in Embodiment 1 or 2 will be referred to by the same reference numbers and their detailed explanation will be omitted.

Figure 10:
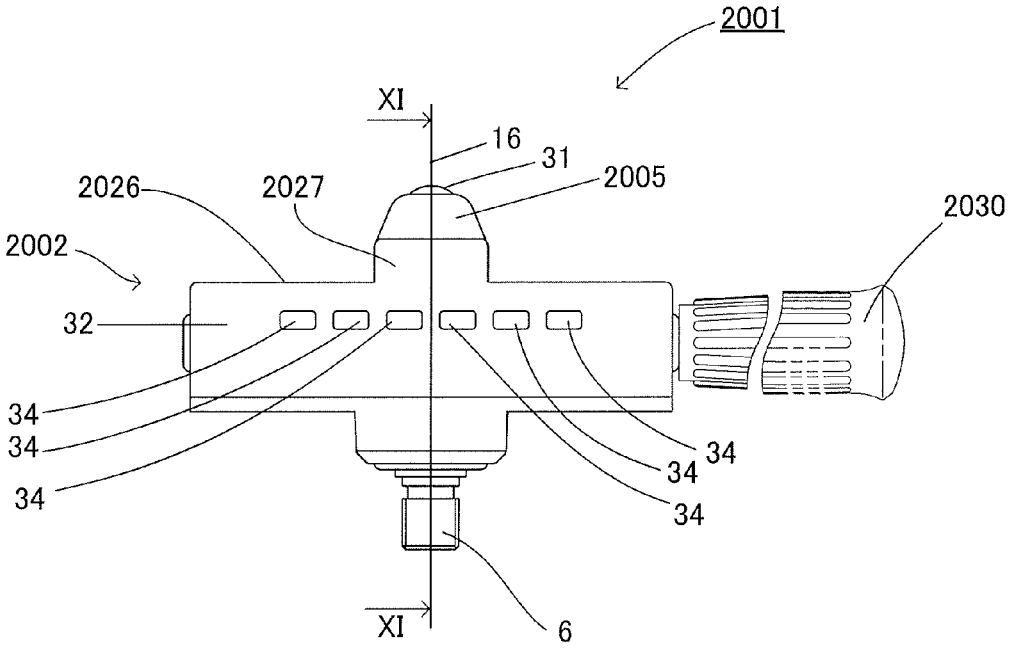
FIG. 10 is a front view of the portable abrasive tool according to Embodiment 3 of the present invention.
Figure 11:
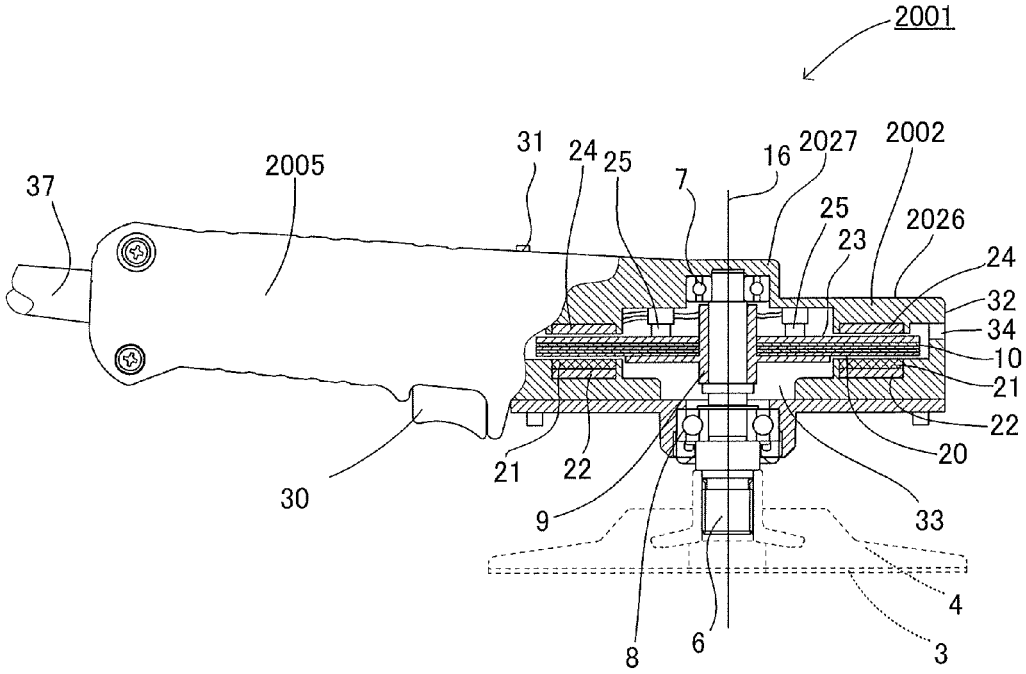
FIG. 11 is a cross-sectional view at the line XI-XI in FIG. 10.
Figure 12:
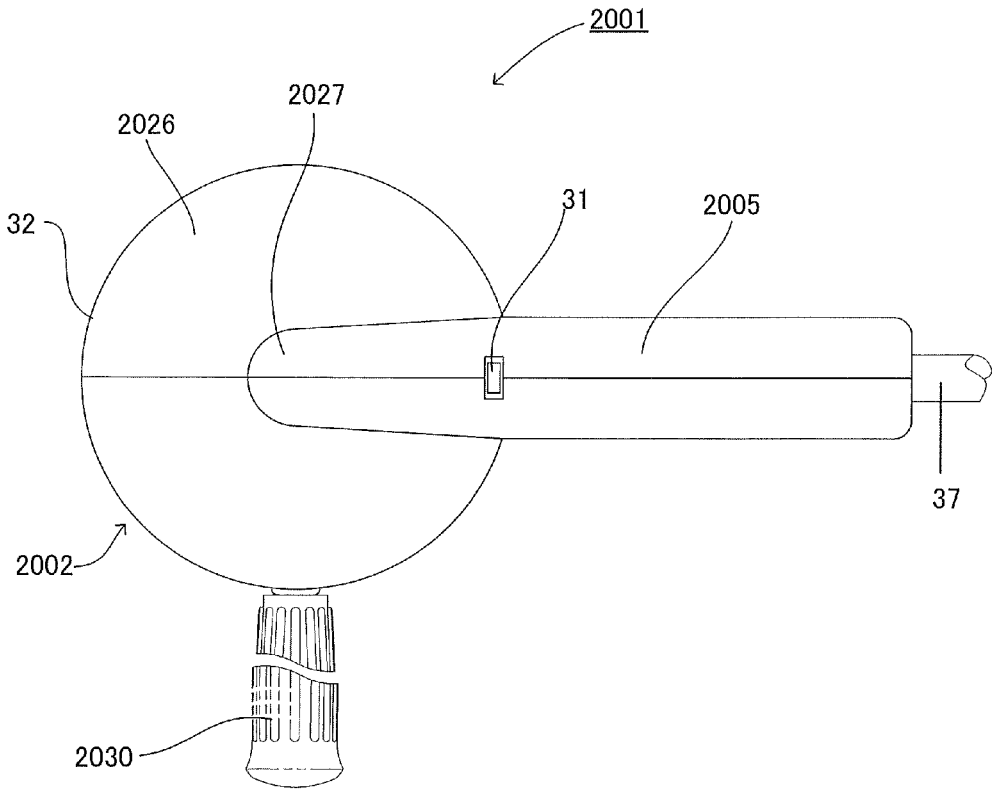
FIG. 12 is a top view of the portable abrasive tool in FIG. 10.

As shown in FIGS. 10, 11, and 12, a side handle 2030 extending from the outer peripheral wall 32 in the direction nearly perpendicular to the axis line 16 of the output shaft 6 is attached to the housing 2002. Furthermore, a handle 2005 is provided integrally with the housing 2002; the handle 2005 extends from a protrusion 2027 protruding from the flat part 2026 of the housing 2002 and the outer peripheral wall 32 of the housing 2002 in the direction nearly perpendicular to the axis line 16 of the output shaft 6 and different from the direction of the side handle 2030. A not-shown power cable is provided in the handle 2005. The power cable extends outside via the cord armor 37 provided at the end of the handle 2005. Furthermore, a trigger switch 30 is provided on the handle 2005 at a position facing in the direction from the coil disk 10 to the pad 4 in the direction of the axis line 16 of the output shaft 6, namely at the lower part in FIG. 11. Furthermore, a dialing-type variable speed switch 31 is provided on the handle 2005 at a position facing in the direction from the pad 4 to the coil disk 10 in the direction of the axis line 16 of the output shaft 6, namely at the upper part in FIG. 11.

The portable abrasive tool 2001 having the above structure has the above-described advantageous effects as a result of using a flat motor. In addition, the side handle 2030 extends from the outer peripheral wall 32 of the housing 2002 in the direction nearly perpendicular to the axis line 16 when seen in the direction of the axis line 16 in addition to the handle 2005. Then, the distance from the gravity center of the handle 2005 of the portable abrasive tool 2001 and the portable abrasive tool 2001 to the abrasive surface of the pad 4 to which the abrasive sheet 3 is attached is reduced. The abrasive surface is not easily tilted with respect to the abrasion-target surface during the operation, improving the operability. Furthermore, the operator can use the hand that is not holding the handle 2005 to hold the flat part 2026 and protrusion 2027 instead of holding the side handle 2030. Then, the operator can choose the best way of holding the portable abrasive tool 2001 depending on the operation state, further improving the operability. Furthermore, the motor is not placed in the handle, the degree of freedom in designing the handle is increased and a handle easier to hold can be provided.

Figure 13:
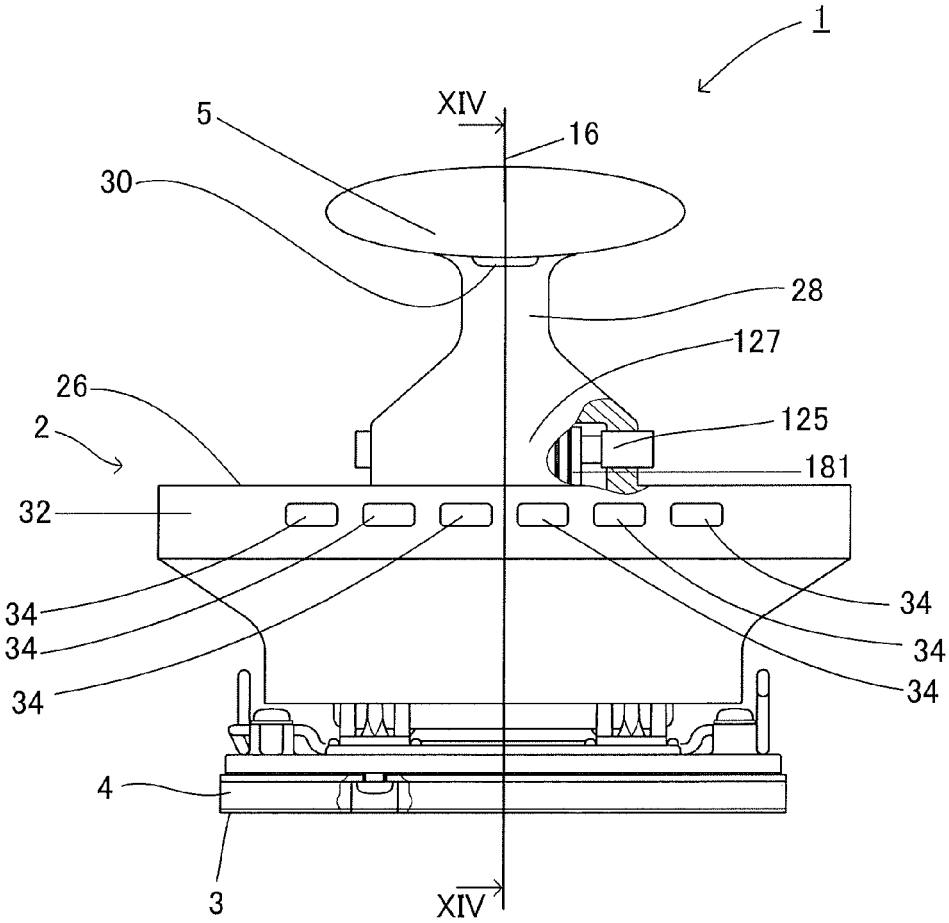
FIG. 13 is a front view of the portable abrasive tool according to a modification of Embodiment 1 of the present invention.
Figure 14:
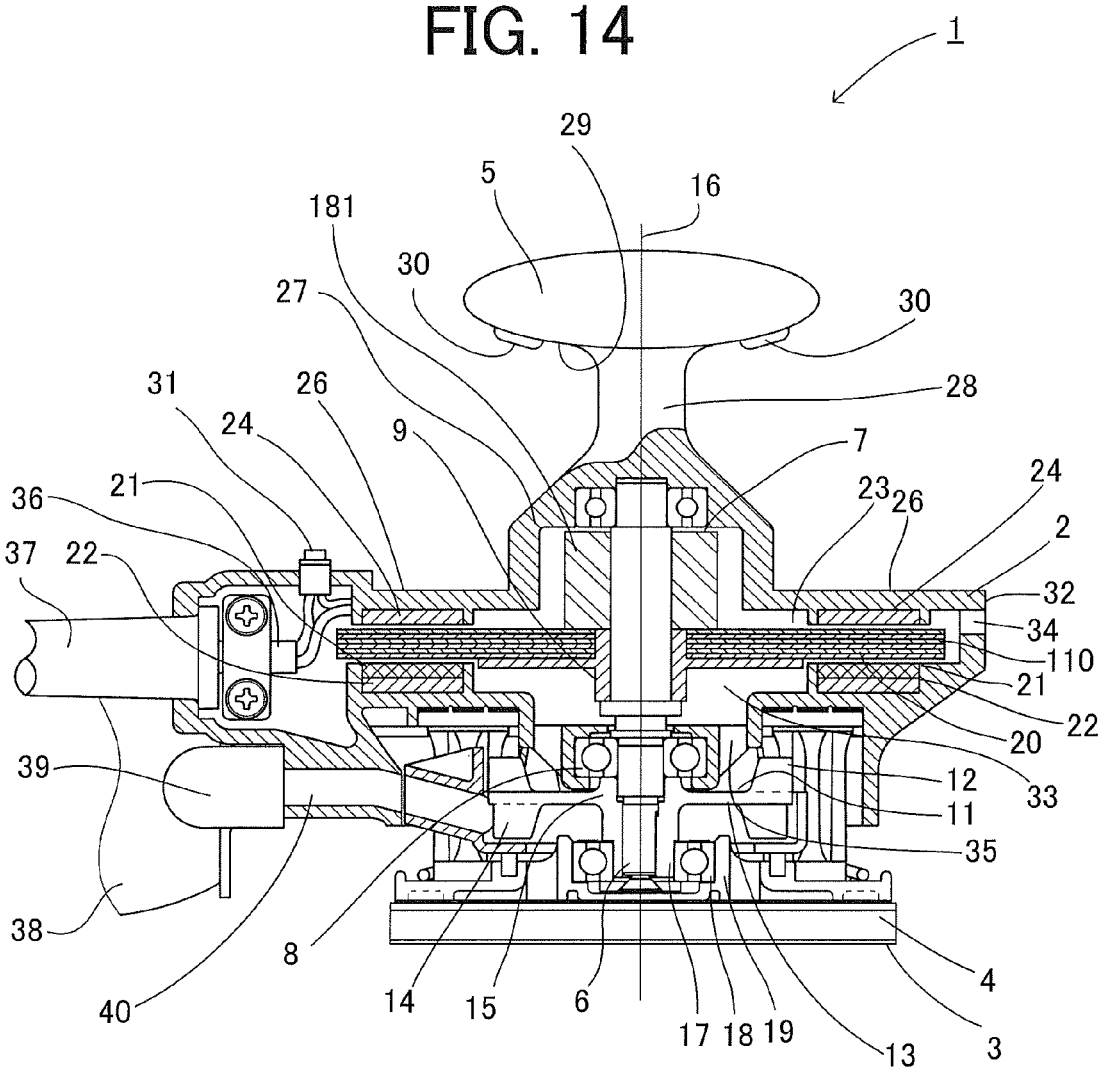
FIG. 14 is a cross-sectional view at the line XIV-XIV in FIG. 13.
Figure 15:
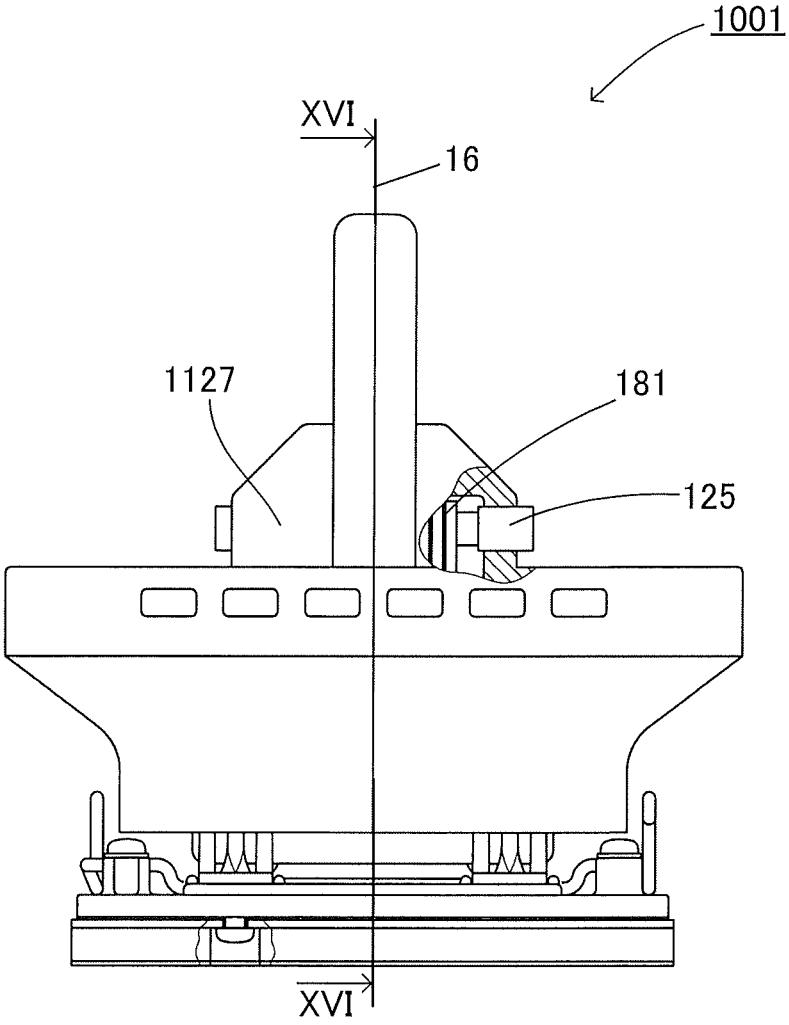
FIG. 15 is a front view of the portable abrasive tool according to a modification of Embodiment 2 of the present invention.
Figure 16:
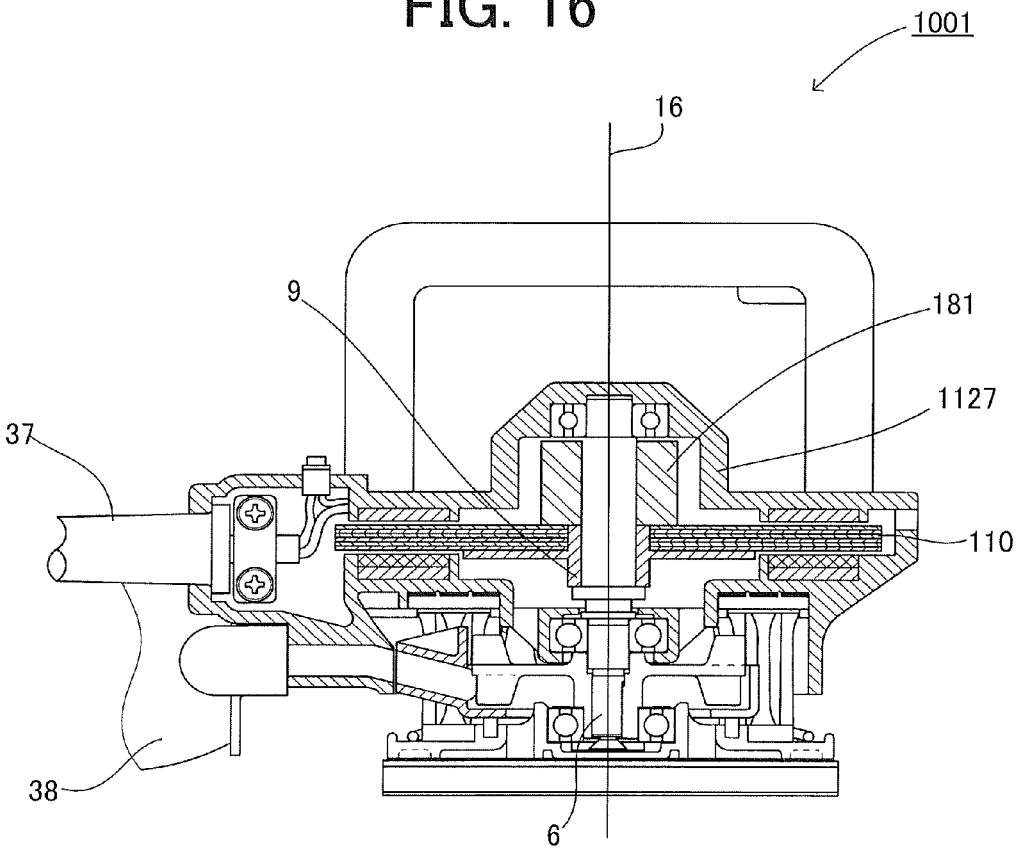
FIG. 16 is a cross-sectional view at the line XVI-XVI in FIG. 15.
Figure 17:
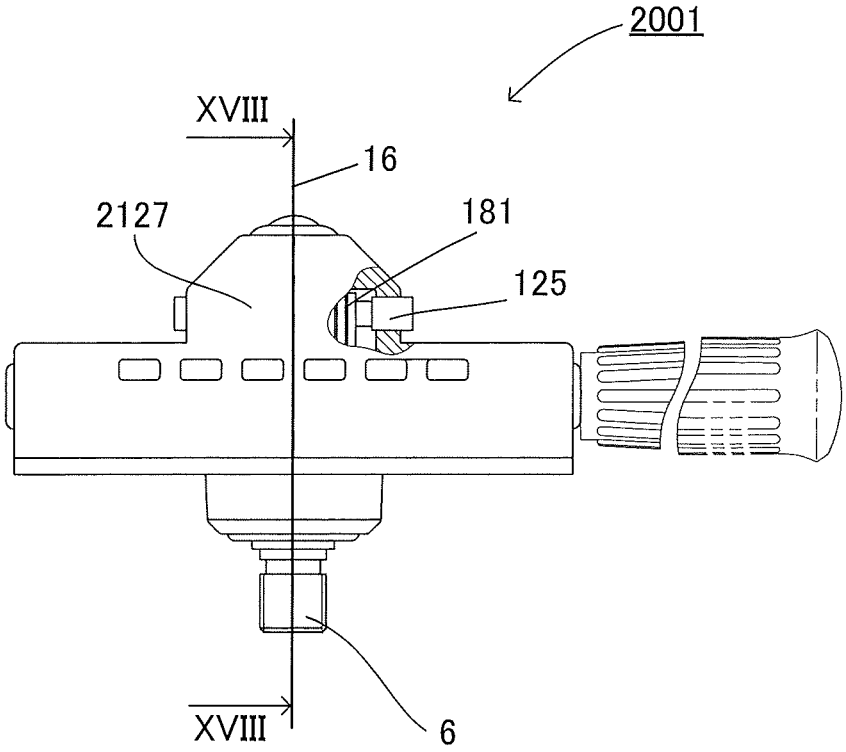
FIG. 17 is a front view of the portable abrasive tool according to a modification of Embodiment 3 of the present invention.
Figure 18:
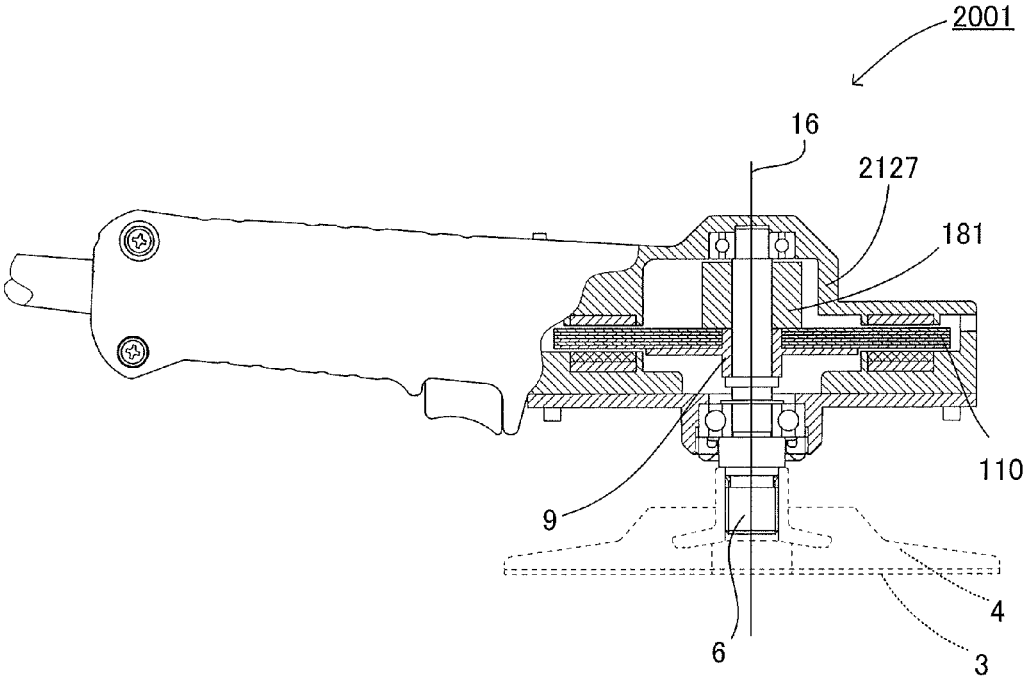
FIG. 18 is a cross-sectional view at the line XVIII-XVIII in FIG. 17.

The above-described Embodiments 1 to 3 comprise the commutator 81 consisting of multiple commutator segments 82 arranged radially about the axis line 16 on the disk surface of the coil/commutator disk 62 constituting the coil disk 10. Then, the brush 25 makes contact with the commutator 81 in the direction of the axis line 16 (the direction perpendicular to the disk surface). However, the structure of the commutator and brush is not confined to the above structure. For example, in a modification of the portable abrasive tool 1 of Embodiment 1 as shown in FIGS. 13 and 14, a cylindrical commutator 181 extending coaxially with the output shaft 6 is provided on the top surface of a coil disk 110 in place of the commutator 81 in the commutator region 80 of the coil/commutator disk 62, and a brush 125 provided on the sidewall of a protrusion 127 makes contact with the commutator 181 in the direction perpendicular to the axis line 16 of the output shaft 6. FIGS. 15 and 16 show a modification of the portable abrasive tool 1001 of Embodiment 2 in which the same structure is applied. Furthermore, FIGS. 17 and 18 show a modification of the portable abrasive tool 2001 of Embodiment 3 in which the same structure is applied. In either case, the cylindrical commutator 181 extending coaxially with the output shaft 6 is provided on the top surface of the coil disk 110. Then, the brush 125 provided on the sidewall of a protrusion 1127 or 2127 makes contact with the commutator 181 in the direction perpendicular to the axis line 16 of the output shaft 6.

When the commutator 181 and brush 125 having the above structure are provided, the brush 125 makes contact with the commutator 181 in the direction perpendicular to the axis line 16 of the output shaft 6. Therefore, the coil disk 110 is not easily subject to side runout, ensuring current supply from the brush 125 to the coil. Furthermore, the individual commutator segments of the commutator 181 can easily be increased in thickness. Then, the commutator 181 can be more durable and the portable abrasive tool 1, 1001, or 2001 can have a longer life.

The above-described embodiments all utilize a flat motor having the coil disk 10 rotating as a part of the rotor and the magnets 21 secured to the housing 2, 1002, or 2002 as the stator. However, the portable abrasive tools 1, 1001, and 2001 are not confined to this. For example, a flat motor unit having an independent motor housing in which the rotor and stator of a flat motor are housed with the output shaft 6 protruding from it can be prepared. Then, the flat motor unit is installed in the housing of the portable abrasive tool. Furthermore, a flat brushless motor in which magnets constitute a stator rotating together with the output shaft 6 and a coil disk constitutes a stator secured to the housing can be utilized. Furthermore, the coil disk does not necessarily consist of printed wiring boards. The motor can comprise a coil disk consisting of, for example, multiple coils arranged in the form of a disk as long as the coil disk is flat and compact.

Further, the embodiments are explained above as having a portable abrasive tool connected to an alternating current source. However, instead, a rechargeable battery may be detachably connected to the device, and the device may be battery-driven. In this case, the battery may be located above the motor to allow, in operation, a user to grip the tool by the periphery of the battery, instead of the handles 5 and 1005 omitted in this case. This structure is advantageous because the overall length of the device is shortened due to absence of the cord armor 37 etc., that may be a cause of the elongated overall length of the tool. Also, this structure is advantageous because the flat motor shape can allow locating the battery above the motor in a compressed size in the latitudinal direction of the tool. Moreover, in this structure, the battery, which is a comparatively weighty element in the device, can locate above the abrasive surface. Therefore, as compared to the structure in which the battery is positioned away from the abrasive surface, the stability of the tool in operation can be increased, and the abrasive surface can be prevented from tilting, to improve the workability.

Having described and illustrated the principles of this application by reference to one or more preferred embodiments, it should be apparent that the preferred embodiments may be modified in arrangement and detail without departing from the principles disclosed herein and that it is intended that the application be construed as including all such modifications and variations insofar as they come within the spirit and scope of the subject matter disclosed herein.

What is claimed is:

1. A portable abrasive tool comprising:

a motor comprising a rotor having an output shaft and a stator wherein one of said rotor and stator has a coil disk in the form of a disk on which multiple coil pieces are arranged in the circumferential direction about said output shaft when seen in the axial direction of said output shaft and the other of said rotor and stator has a magnetic flux generation unit that is arranged along an axial direction of an output shaft for generating a magnetic flux passing through said coil disk in the axial direction of said output shaft; and an abrasive part connected to one end of said output shaft of the motor, wherein said coil disk comprises a laminate of multiple disks in the axial direction.

2. The portable abrasive tool according to claim 1, wherein:

said coil disk is provided to said rotor;

said stator constitutes a housing which rotatably supports said output shaft and encloses said coil disk;

said magnetic flux generation unit comprises magnets;

a handle is provided to said housing; and said motor is provided between said handle and abrasive part.

3. The portable abrasive tool according to claim 1, wherein:

said coil disk is provided to said rotor;

said stator constitutes a housing which rotatably supports said output shaft and encloses said coil disk;

said magnetic flux generation unit comprises magnets;

said housing has a flat part nearly parallel to a disk surface of said coil disk on the side where the other end of said output shaft is situated, and a nearly columnar protrusion protruding from the flat part nearly coaxially with said output shaft and having a diameter smaller than the diameter of said coil disk; and a handle for the operator to hold is provided at the end of the protrusion that is away from said flat part.

4. The portable abrasive tool according to claim 3, wherein:

said handle has a facing-the-housing part facing said flat part of said housing and having an outer peripheral edge outside the outer diameter of said protrusion when seen in the axial direction of said output shaft; and a control switch for controlling the operation of said motor is provided on said facing-the-housing part of said handle.

5. The portable abrasive tool according to claim 1, wherein:

said coil disk is provided to said rotor;

said stator constitutes a housing which rotatably supports said output shaft and encloses said coil disk;

said housing has a flat part nearly parallel to the disk surface of said coil disk on the side where the other end of said output shaft is situated; and a handle for the operator to hold is provided on the flat part, said handle having a handle protrusion protruding from said flat part in the axial direction of said output shaft and a handle grip extending from the end of said handle protrusion that is away from said flat part nearly in parallel to said flat part.

6. The portable abrasive tool according to claim 5, wherein a control switch for controlling the operation of said motor is provided on said handle grip at a position facing said flat part.

7. The portable abrasive tool according to claim 5, wherein:

a power cord protrusion protruding in the direction nearly perpendicular to the axial direction of said output shaft and in which a power cord for feeding said motor runs is provided to said housing; and said handle grip of said handle passes through nearly the center of said output shaft when seen in the axial direction of said output shaft and extends nearly in parallel to said power cord protrusion.

8. The portable abrasive tool according to claim 1, wherein:

said coil disk is provided to said rotor;

said stator constitutes a housing which rotatably supports said output shaft and encloses said coil disk;

said housing has a flat part nearly parallel to the disk surface of said coil disk on the side where the other end of said output shaft is situated; and a side handle for the operator to hold is provided to said housing, said side handle protruding from said housing in the direction nearly perpendicular to the axial direction of said output shaft when seen in the axial direction of said output shaft.

9. The portable abrasive tool according to claim 2, wherein said magnets are provided in said housing in the manner that they face one of the disk surfaces of said coil disk.

10. The portable abrasive tool according to claim 2, wherein:

said housing has an outer peripheral wall facing the circumference of said coil disk; and multiple cooling holes communicating with the interior of said housing accommodating said coil disk are formed in the outer peripheral wall.

11. The portable abrasive tool according to claim 1, wherein said rotor has an outer diameter radially larger than a diameter of said abrasive part.

* * * * *